US007237519B2

(12) United States Patent
Wang et al.

(10) Patent No.: US 7,237,519 B2
(45) Date of Patent: Jul. 3, 2007

(54) ROCKER ARM FOR AN ENGINE

(75) Inventors: Chin-Tang Wang, Tainan (TW); Ieng-Heong Lio, Shatin (HK)

(73) Assignee: JI-EE Industry Co., Ltd., Tainan Hsien (TW)

( * ) Notice: Subject to any disclaimer, the term of this patent is extended or adjusted under 35 U.S.C. 154(b) by 25 days.

(21) Appl. No.: 11/194,269

(22) Filed: Aug. 1, 2005

(65) Prior Publication Data

US 2007/0022991 A1 Feb. 1, 2007

(51) Int. Cl.
*F01L 1/18* (2006.01)

(52) U.S. Cl. ..... 123/90.39; 123/90.44; 74/559

(58) Field of Classification Search ..... 123/90.39, 123/90.41, 90.44, 90.16, 90.2; 74/519, 559, 74/569

See application file for complete search history.

(56) References Cited

U.S. PATENT DOCUMENTS 5,038,726 A 8/1991 Pryba
6,474,282 B1 * 11/2002 Pryba et al. ..... 123/90.39

* cited by examiner

*Primary Examiner*—Ching Chang
(74) *Attorney, Agent, or Firm*—Akin Gump Strauss Hauer & Feld LLP

(57) ABSTRACT

A rocker arm is adapted for use with an engine including a push rod, a valve unit and a pivot ball disposed on a supporting frame. The rocker arm is connected pivotally to the supporting frame, and includes a main plate having a central opening defined by an upper edge, a horizontal lower edge disposed under the upper edge, and two curved lateral edges interconnecting the upper and lower edges. The lower edge has an intermediate portion formed with an outwardly flared recess that defines an upwardly facing socket engaging the pivot ball. A first arm plate is connected integrally to a lateral side of the main plate and is driven by the push rod. A second arm plate is connected integrally to an opposite lateral side of the main plate and operates the valve unit.

1 Claim, 6 Drawing Sheets

ROCKER ARM FOR AN ENGINE

BACKGROUND OF THE INVENTION

1. Field of the Invention

The invention relates to an engine, more particularly to a rocker arm for an engine.

2. Description of the Related Art

Referring to FIG. 1, a conventional rocker arm 1, such as that disclosed in U.S. Pat. No. 5,038,726, is formed as a one-piece metal plate, is pivotally supported by a supporting frame, and has one end portion 12 driven by a push rod, another end portion 13 engaging a valve stem, and an intermediate portion 11 formed with an opening 111 of generally trapezoidal configuration defined by a lower edge 116 longer than a round upper edge 115, and two straight lateral edges 114 interconnecting the upper and lower edges 115, 116. The lower edge 116 has two rounded bottom edge portions 113, and a middle portion disposed between the bottom edge portions 113 and formed with upwardly-facing pivot ball socket 112.

During operation, the conventional rocker arm 1 is pivotable between the push rod and the valve stem about a pivot ball received in the pivot ball socket 112 as a fulcrum so as to transmit power. However, due to the presence of the bottom edge portions 113, stress acting on the conventional rocker arm 1 during operation easily concentrates on a wall defining the bottom edge portions 113 and the corners between the lateral edges 114 and the bottom edge portions 113. As such, the conventional rocker arm 1 easily cracks at the bottom edge portions 113 and the corners between the lateral edges 114 and the bottom edge portions 113 after a period of use.

SUMMARY OF THE INVENTION

Therefore, the object of the present invention is to provide a rocker arm for an engine that can prevent stress concentration on a wall defining an opening during operation.

According to the present invention, there is provided a rocker arm for an engine. The engine includes a supporting frame, a push rod, a valve unit and a pivot ball disposed on the supporting frame. The rocker arm is adapted to be connected pivotally to the supporting frame, and is adapted to be driven by the push rod to operate the valve unit. The rocker arm comprises:

a main plate having opposite lateral sides and formed with a central opening defined by an upper edge, a horizontal lower edge disposed under the upper edge, and two curved lateral edges interconnecting the upper and lower edges, the lower edge having an intermediate portion formed with an outwardly flared recess that defines an upwardly facing socket adapted to engage the pivot ball;

a first arm plate connected integrally to one of the lateral sides of the main plate and adapted to be driven by the push rod; and a second arm plate connected integrally to the other one of the lateral sides of the main plate and adapted to operate the valve unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
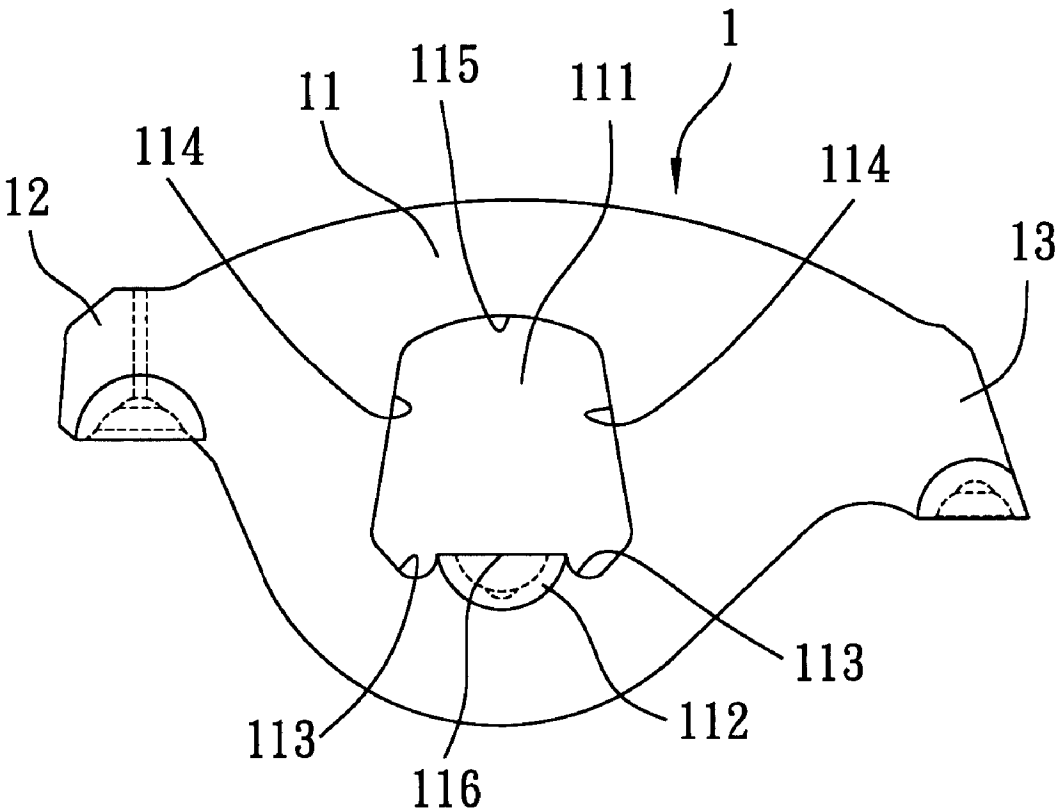
FIG. 1 PRIOR ART
FIG. 1 is a schematic side view of a conventional rocker arm for an engine.
Figure 2:
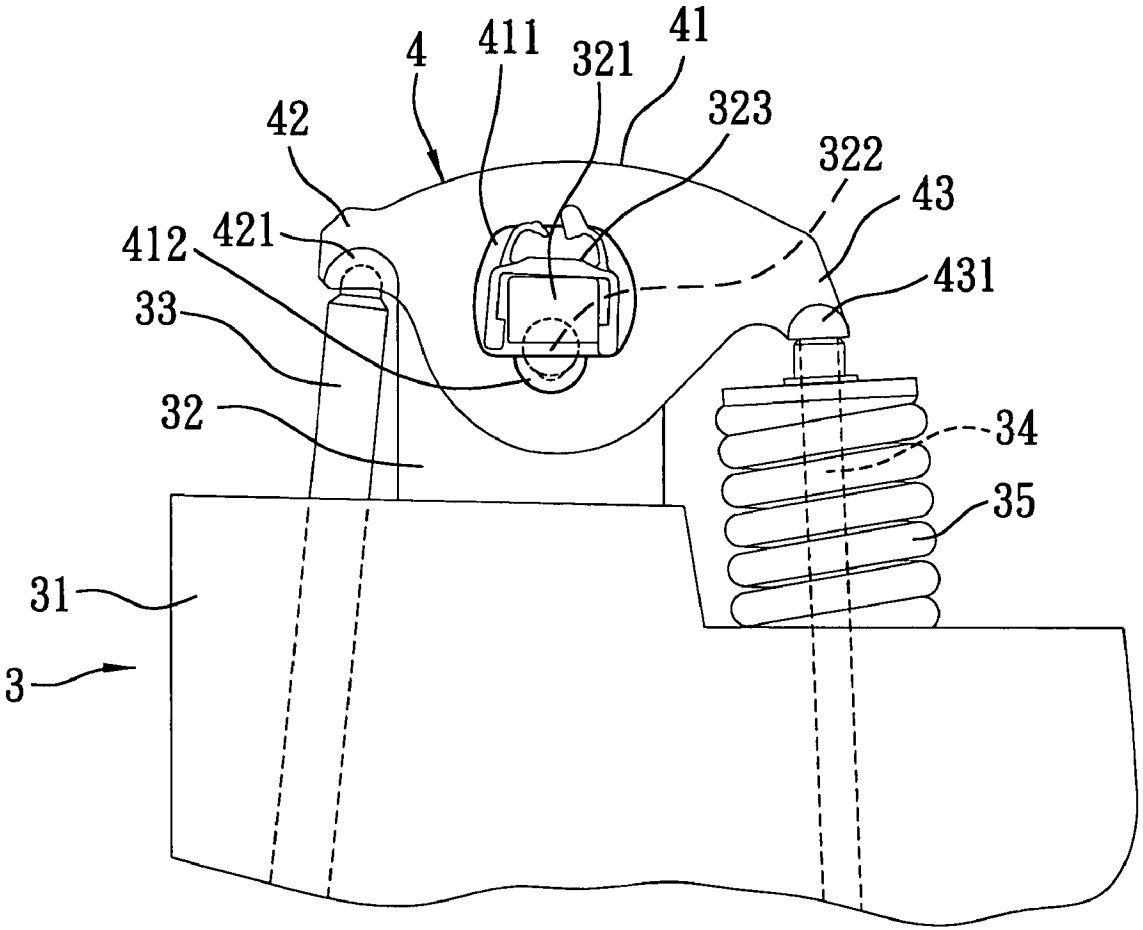
FIG. 2 is a schematic side view showing the preferred embodiment of a rocker arm assembled to an engine according to the present invention.
Figure 3:
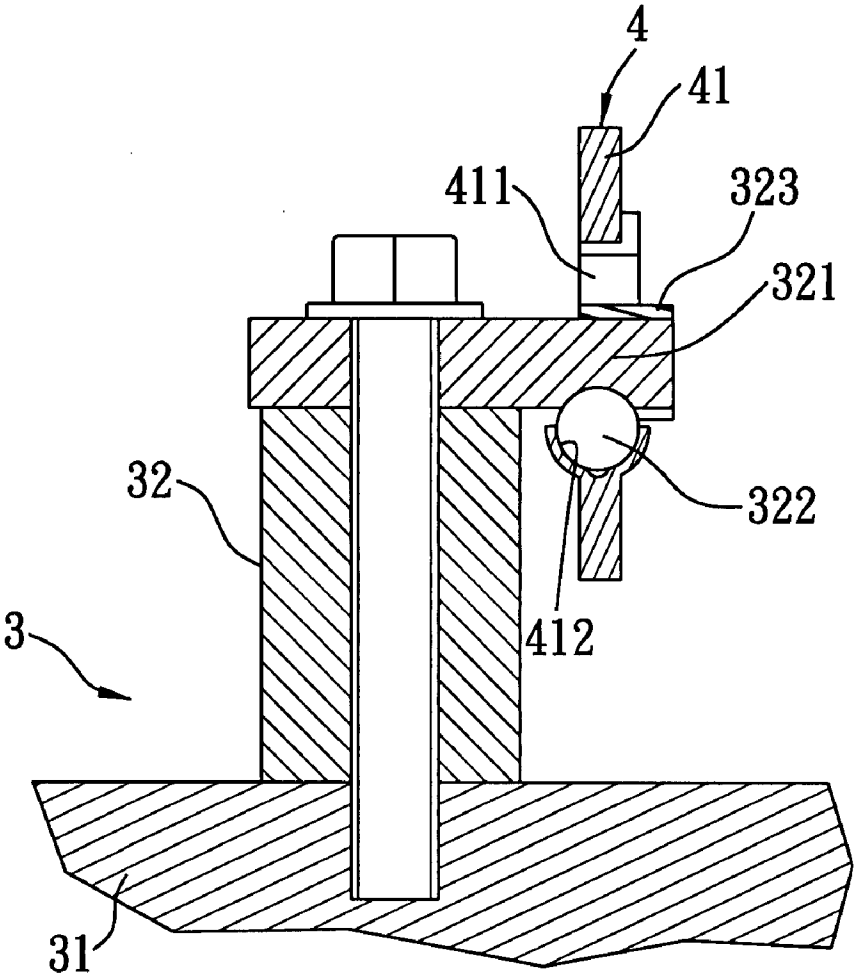
FIG. 3 is a schematic sectional view showing the preferred embodiment.
Figure 4:
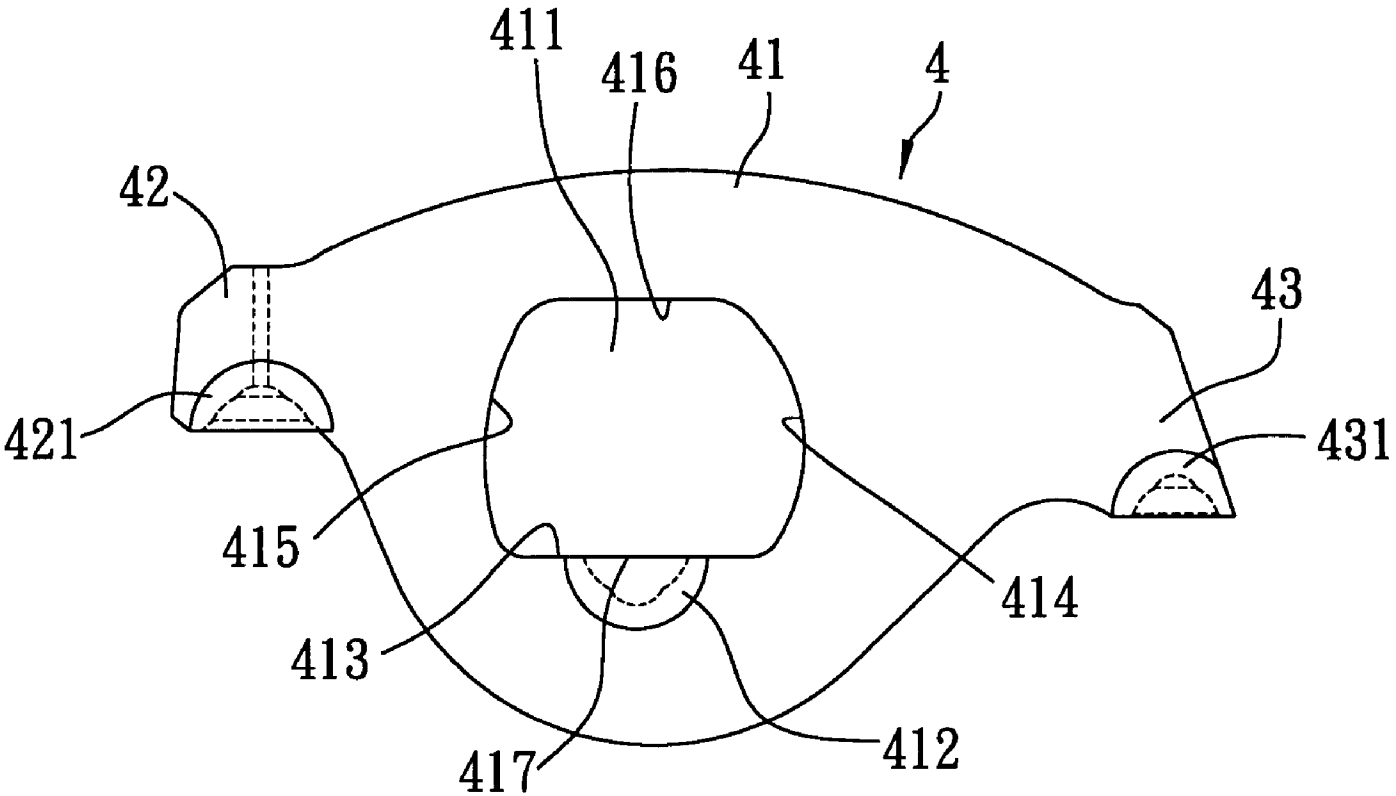
FIG. 4 is a schematic side view showing the preferred embodiment.

Referring to FIGS. 2 to 4, the preferred embodiment of a rocker arm 4 according to the present invention is shown to be adapted for use with an engine 3. The engine 3 includes an engine body 31, a supporting frame 32 mounted on top of the engine body 31, a push rod 33 provided at a side of the engine body 31 and driven by a cam (not shown) so as to move upwardly and downwardly, and a valve unit provided at an opposite side of the engine body 31 and having a valve stem 34 and a biasing spring 35, as shown in FIG. 2. The supporting frame 32 has a bearing support 321, a pivot ball 322 mounted rotatably under bottom of the bearing support 321, and a plastic sleeve 323 mounted around the bearing support 321, as shown in FIG. 3.

The rocker arm 4 is integrally formed as a metal plate, is adapted to be connected pivotally to the supporting frame 32, and is adapted to be driven by the push rod 33 to operate the valve stem 34. The rocker arm 4 includes a main plate 41, a first arm plate 42, and a second arm plate 43.

The main plate 41 has opposite left and right lateral sides, and is formed with a central opening 411 permitting extension of the bearing support 321 mounted with the plastic sleeve 323 therethrough (see FIG. 3) and defined by a horizontal upper edge 416, a horizontal lower edge 413 disposed under the upper edge 416, and curved left and right lateral edges 415, 414 interconnecting the upper and lower edges 416, 413, as best shown in FIG. 4. The lower edge 413 has an intermediate portion 417 formed with an outwardly flared recess 412 that defines an upwardly facing socket adapted to engage the pivot ball 322. In this embodiment, each of the left and right lateral edges 415, 414 of the opening 411 is outwardly concaved. The right lateral edge 414 of the opening 411 has a curvature radius smaller than that of the left lateral edge 415 of the opening 411.

The first arm plate 42 is connected integrally to the left lateral side of the main plate 41, and is adapted to be driven by the push rod 33. In this embodiment, the first arm plate 42 is formed with a downwardly facing recess 421 that fits over an upper end of the push rod 33, as shown in FIG. 2.

The second arm plate 43 is connected integrally to the right lateral side of the main plate 41, and is adapted to operate the valve stem 34 of the valve unit. In this embodiment, the second arm plate 43 is formed with a downwardly facing recess 431 that fits over an upper end of the valve stem 34, as shown in FIG. 2.

During operation, upward movement of the push rod 33 enables the rocker arm 4 to rotate about the pivot ball 322 as a fulcrum in a clockwise direction, thereby driving the valve stem 34 to move downwardly such that the biasing spring 35 is compressed. On the other hand, when the push rod 33 ceases moving, a biasing force from the compressed biasing spring 35 drives the rocker arm 4 to rotate about the pivot ball 322 as a fulcrum in a counterclockwise direction, thereby driving the push rod 33 to move downwardly.

Figure 5A:
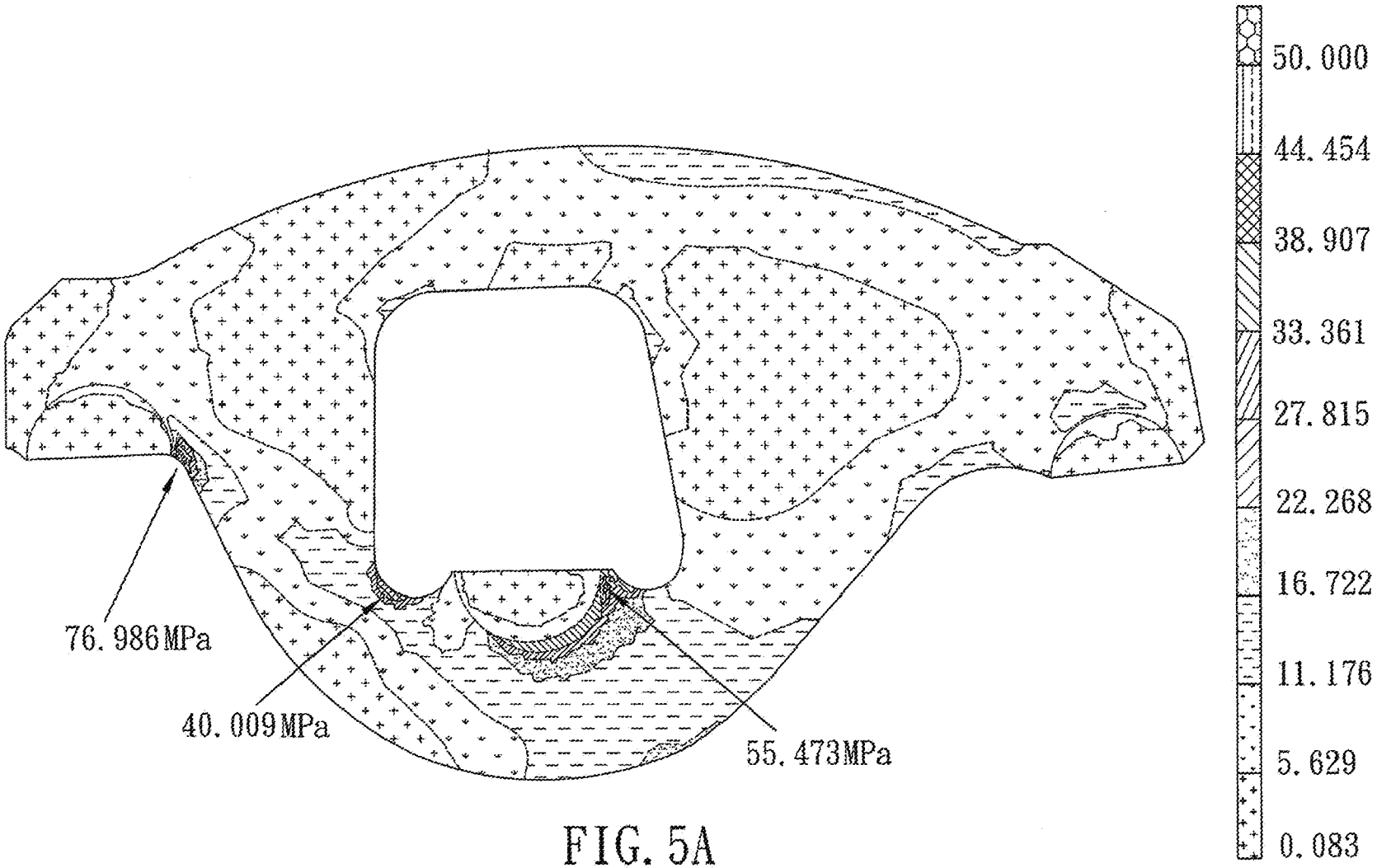
FIGS. 5A and 5B illustrate experimental results of stress distributions of the aforesaid conventional rocker arm and the preferred embodiment during operation, respectively.
Figure 5B:
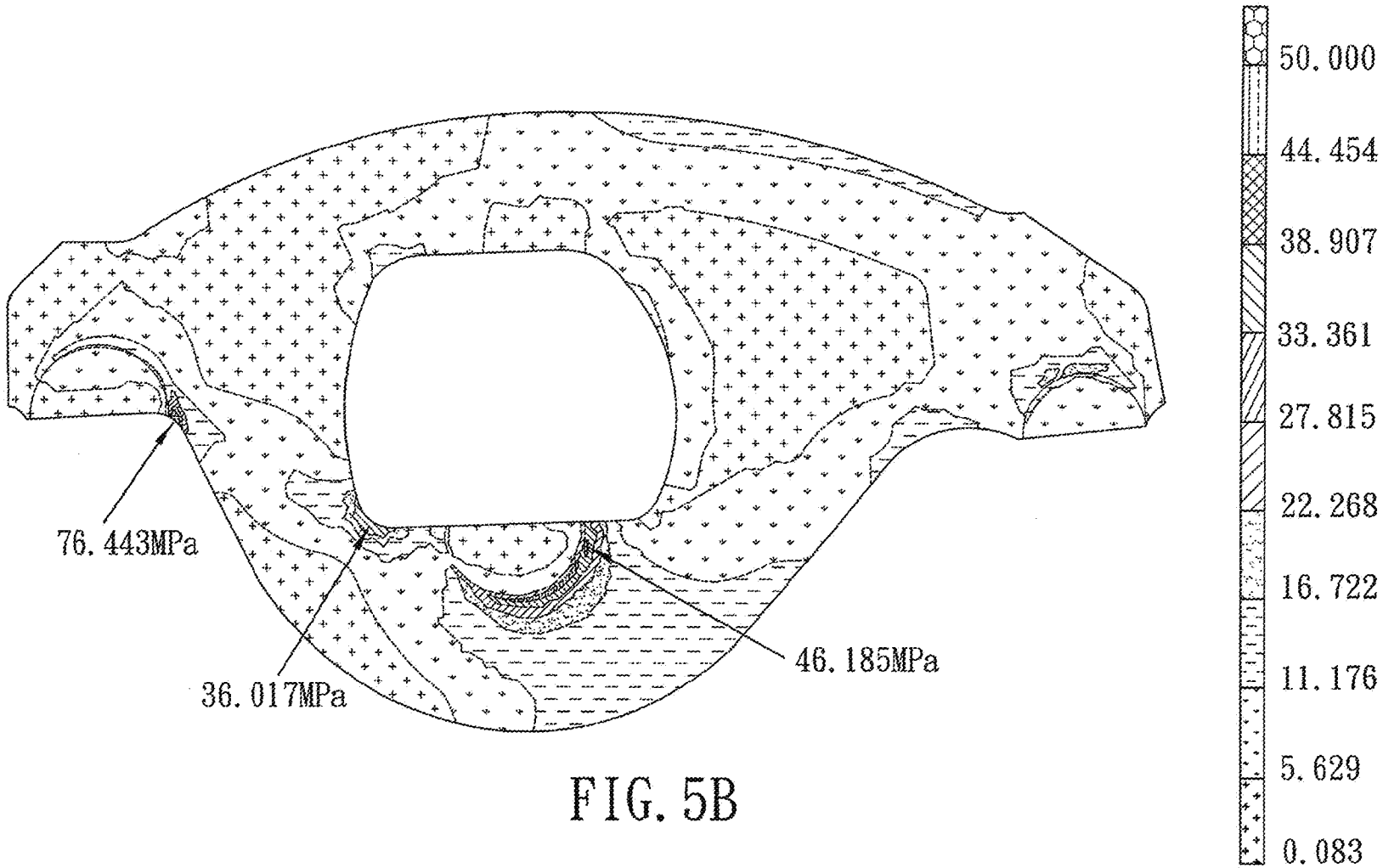

It is noted that, since the lower edge 413 of the opening 411 is substantially straight, stress generated at the vicinity of the corners between the lower edge 413 and the left and right lateral edges 415, 414 during operation are indicated by "Fillet 2" and "Fillet 3" in FIG. 5B, and is relatively small as compared to that of the aforesaid conventional rocker arm 1 shown in FIG. 5A. Accordingly, during operation of the rocker arm 4 of the present invention, stress concentration on a wall defining the opening 411 can be prevented such that the service life of the rocker arm 4 can be prolonged.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A rocker arm for an engine, the engine including a supporting frame, a push rod, a valve unit and a pivot ball disposed on the supporting frame, said rocker arm being adapted to be connected pivotally to the supporting frame and being adapted to be driven by the push rod to operate the valve unit, said rocker arm comprising:

a main plate having opposite lateral sides and formed with a central opening defined by an upper edge, a horizontal lower edge disposed under said upper edge, and two curved lateral edges interconnecting said upper and lower edges, each of said lateral edges of said opening is outwardly concaved, said lower edge having an intermediate portion formed with and outwardly flared recess that defines an upwardly facing socket adapted to engage the pivot ball;

a first arm plate connected integrally to one of said lateral sides of said main plate and adapted to be driven by the push rod; and a second arm plate connected integrally to the other one of said lateral sides of said main plate and adapted to operate the valve unit, wherein said lateral edges of said opening are adjacent respectively to said first and second arm plates, one of said lateral edges of said opening adjacent to said second arm plate having a curvature radius smaller than that of the other one of said lateral edges of said opening adjacent to said first arm plate.

* * * * *